US005401386A

United States Patent [19]

Morrison et al.

[11] Patent Number: 5,401,386

[45] Date of Patent: Mar. 28, 1995

[54] REFORMING PROCESS FOR PRODUCING HIGH-PURITY BENZENE

[75] Inventors: Scott G. Morrison, Petaluma; Warren E. Brown, Hercules, both of Calif.

[73] Assignee: Chevron Research and Technology Company

[21] Appl. No.: 95,844

[22] Filed: Jul. 23, 1993

Related U.S. Application Data

[63] Continuation-in-part of Ser. No. 919,476, Jul. 24, 1992.

[51] Int. Cl.[6] ..... C07C 5/00; C10G 35/06

[52] U.S. Cl. ..... 208/65; 208/138; 208/141; 585/322; 585/419

[58] Field of Search ..... 208/65, 70, 60, 137, 208/138, 141, 139; 585/322, 407, 411, 413, 419, 431, 434, 441, 804, 807

[56] References Cited

U.S. PATENT DOCUMENTS

| | | | |
|---|---|---|---|
| 2,867,576 | 1/1959 | Honeycut . | |
| 2,881,862 | 4/1959 | Fleck et al. . | |
| 2,944,959 | 7/1960 | Kline et al. . | |
| 2,956,005 | 10/1960 | Lutz et al. . | |
| 3,003,949 | 10/1961 | Hamilton . | |
| 3,018,244 | 1/1962 | Staford et al. . | |
| 3,121,676 | 2/1964 | Skraba . | |
| 3,172,841 | 3/1965 | Paterson . | |
| 3,280,022 | 10/1966 | Engel et al. . | |
| 3,409,540 | 11/1968 | Gould et al. . | |
| 3,466,344 | 9/1969 | Graff et al. . | |
| 3,753,891 | 8/1973 | Graven et al. . | |
| 3,776,949 | 12/1973 | Gelbein et al. . | |
| 3,992,465 | 11/1976 | Juguin et al. | 208/65 |
| 4,104,320 | 8/1978 | Bernard et al. . | |
| 4,167,472 | 9/1979 | Dick et al. . | |
| 4,347,394 | 8/1982 | Detz et al. . | |
| 4,358,364 | 11/1982 | Klozek et al. . | |
| 4,594,145 | 6/1986 | Roarty | 208/138 |
| 4,645,586 | 2/1987 | Buss . | |
| 4,648,961 | 3/1987 | Jacobson et al. . | |
| 4,897,177 | 1/1990 | Nadler | 208/141 |
| 5,157,200 | 10/1992 | Mikkinen et al. . | |
| 5,210,348 | 5/1993 | Hsieh et al. . | |

FOREIGN PATENT DOCUMENTS

| | | |
|---|---|---|
| 596523 | 4/1960 | Canada . |

*Primary Examiner*—Asok Pal
*Assistant Examiner*—Bekir L. Yildirim
*Attorney, Agent, or Firm*—Burns, Doane, Swecker & Mathis

[57] ABSTRACT

Provided is a reforming process for producing a high purity benzene product using a non-acidic zeolitic catalyst. The high purity benzene is extracted from a light fraction of reformate that has less than 500 ppm by weight toluene. Generally, a hydrocarbon feed is reformed in a reformer under reforming conditions in the presence of a non-acidic catalyst to produce a reformate. That reformate is separated into a light fraction and a heavy fraction. The extraction unit, preferably an extractive distillation unit, is then used to separate the light fraction into an aromatic extract stream and a nonaromatic raffinate stream.

52 Claims, 1 Drawing Sheet

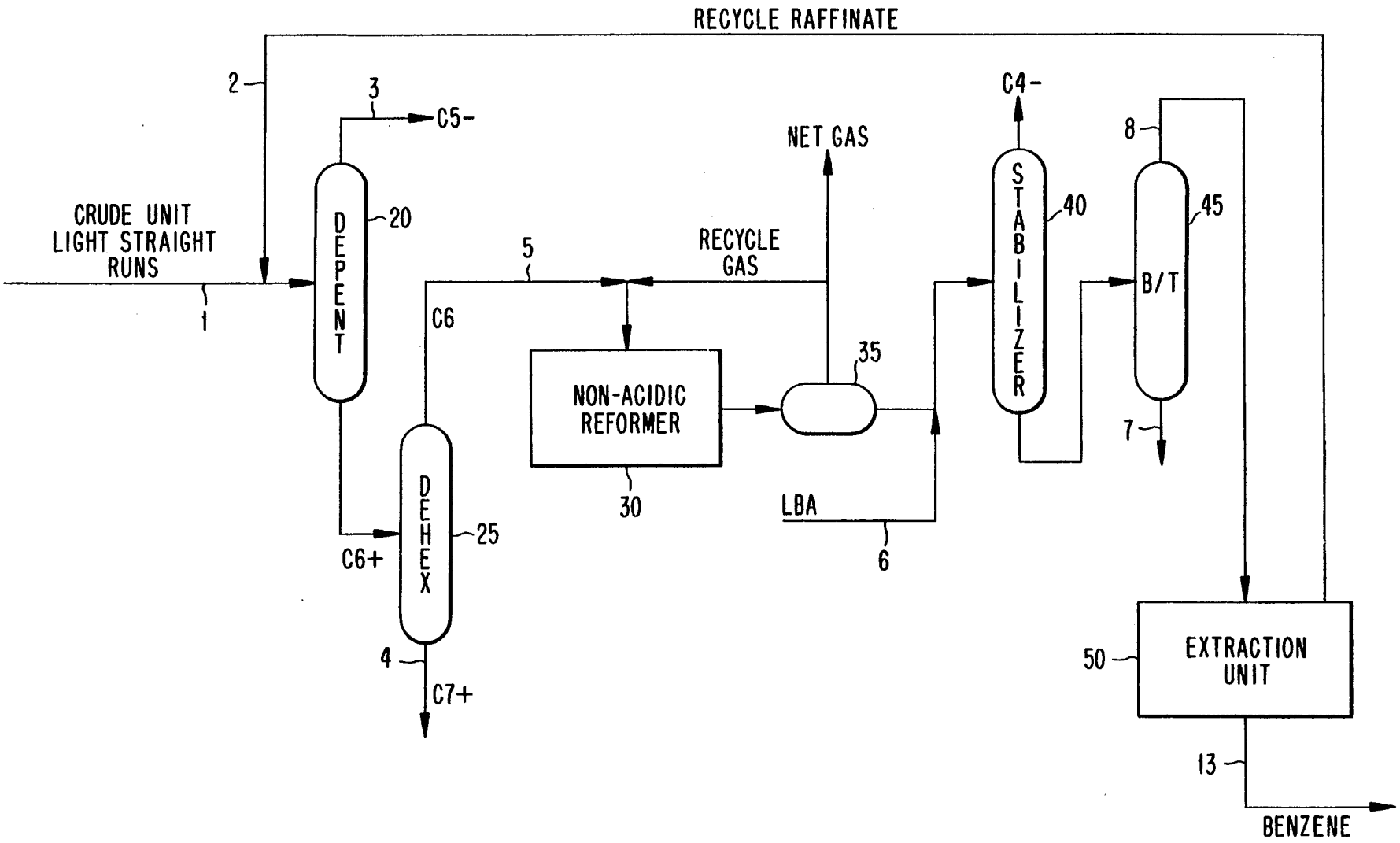
RECYCLE RAFFINATE
CRUDE UNIT LIGHT STRAIGHT RUNS
1
2
DEPENT
20
3
C5-
C6+
DEHEX
25
C6
4
C7+
5
NON-ACIDIC REFORMER
30
RECYCLE GAS
NET GAS
35
LBA
6
STABILIZER
40
C4-
B/T
45
8
7
EXTRACTION UNIT
50
13
BENZENE

REFORMING PROCESS FOR PRODUCING HIGH-PURITY BENZENE

CROSS REFERENCE TO RELATED APPLICATIONS

This application is a continuation-in-part of U.S. Ser. No. 919,476, filed Jul. 24, 1992, which is hereby incorporated by reference in its entirety.

REFORMING PROCESS FOR PRODUCING HIGH-PURITY BENZENE

The present invention relates to a process for reforming a full-boiling range hydrocarbon feed to enhance benzene purity. This process includes separating the hydrocarbon feed into fractions, treating each fraction separately to catalytic reforming, then recovering the products.

BACKGROUND OF THE INVENTION

The reforming of petroleum hydrocarbon streams is an important petroleum refining process which is employed to provide high octane hydrocarbon blending components for gasoline. The process is usually practiced on a straight run naphtha fraction which has been hydro-desulfurized. Straight run naphtha is typically highly paraffinic in nature, but may contain significant amounts of naphthenes and minor amounts of aromatics or olefins. In a typical reforming process, the reactions include dehydrogenation, isomerization, and hydrocracking. The dehydrogenation reactions typically will be the dehydroisomerization of alkylcyclopentanes, to aromatics, the dehydrogenation of paraffins to olefins, the dehydrogenation of cyclohexanes to aromatics, and the dehydrocyclization of paraffins to aromatics. The aromatization of the n-paraffins to aromatics is generally considered to be the most important because of the high octane of the resulting aromatic product compared to the low octane ratings for n-paraffins. The isomerization reactions include isomerization of n-paraffins to isoparaffins, and the isomerization of substituted aromatics. The hydro-cracking reactions include the hydrocracking of paraffins and hydrodesulfurization of any sulfur which is remaining in the feedstock.

It is well known in the art that several catalysts are capable of reforming petroleum naphthas and hydrocarbons that boil in the gasoline boiling range. Examples of known catalysts useful for reforming include platinum and optionally rhenium or iridium on an alumina support, platinum on type X and Y zeolites, platinum on intermediate pore size zeolites as described in U.S. Pat. No. 4,347,394 and platinum on cation exchanged type L zeolites. U.S. Pat. No. 4,104,320 discloses the dehydrocyclization of aliphatic hydrocarbon to aromatics by contact with a catalyst comprising a Type L zeolite containing alkali metal ions and a Group VIII metal such as platinum.

The conventional reforming catalyst is a bifunctional catalyst which contains a metal hydrogenation-dehydrogenation component which is usually dispersed on the surface of a porous inorganic oxide support, usually alumina. Platinum has been widely used commercially in the production of reforming catalysts, and platinum on alumina catalysts have been commercially employed in refineries for the past few decades. More recently, additional metallic components have been added to the platinum to further promote the activity or selectivity, or both. Examples of such metallic components are iridium rhenium, tin and the like. Some catalysts possess superior activity, or selectivity, or both as contrasted with other catalysts. Platinum-rhenium catalysts, for example, possess high selectivity in comparison to platinum catalysts. Selectivity is generally defined as the ability of the catalyst to produce yields of $C_{5+}$ liquid products with concurrent low production of normally gaseous hydrocarbons.

There exist several processes for dividing naphtha feedstreams into a higher boiling and a lower boiling cut and reforming these cuts separately. U.S. Pat. No. 2,867,576 discloses separating straight run naphtha into lower and higher boiling cuts, in which the higher boiling cuts are reformed with a hydrogenation-dehydrogenation catalyst with the liquid reformate produced being routed to an aromatics separation process. The paraffinic fraction obtained from the separation process is blended with the lower boiling naphtha fraction and the resulting blend is reformed with a reforming catalyst which may or may not be the same type employed in reforming the high boiling cut.

U.S. Pat. No. 2,944,959 discloses fractionating a full straight run gasoline into a light paraffinic fraction, $C_5$ and $C_6$, which is hydroisomerized with hydrogen and a pt-alumina catalyst, a middle fraction which is catalytically reformed with hydrogen and a pt-alumina catalyst, and a heavy fraction which is catalytically reformed with a molybdenum oxide catalyst and recovering the liquid products. U.S. Pat. Nos. 3,003,949, 3,018,244 and 3,776,949 also disclose fractionating a feed into a $C_5$ and $C_6$ fraction which is isomerized and a heavier fraction which is reformed.

Other processes for dividing feedstocks and separately treating them include: U.S. Pat. Nos. 3,172,841 and 3,409,540 which disclose separating fraction of a hydrocarbon feedstock and catalytically reforming various fractions of the feed; U.S. Pat. No. 4,167,472 which discloses separating straight chain from non-straight chain $C_6$–$C_{10}$ hydrocarbons and separately converting to aromatics; and U.S. Pat. No. 4,358,364 which discloses catalytically reforming a $C_6$ fraction and producing additional benzene by hydrogasifying a $C_{5-}$ fraction, a fraction with a boiling point above 300° F. and the gas stream produced from catalytic reforming.

U.S. Pat. No. 3,753,891 discloses fractionating a straight run naphtha into a light naphtha fraction containing the $C_6$ and a substantial portion of the $C_7$ hydrocarbons and a heavy naphtha fraction boiling from about 200° to 400° F.; then reforming the light fraction to convert naphthenes to aromatics over a Pt-alumina catalyst or a bimetallic reforming catalyst; separately reforming the heavy faction, then upgrading the reformer effluent of the low boiling fraction over a ZSM-5 type zeolite catalyst to crack the paraffins and recovering an effluent with improved octane rating.

U.S. Pat. No. 4,645,586 discloses parallel reforming of a hydrocarbons feed. In one stream, the hydrocarbons are reformed with an acidic catalyst. In the second stream, the hydrocarbons are reformed with a non-acidic catalyst.

U.S. Re. Pat. No. 33,323 discloses solvent extraction of a light fraction of a reformate. A hydrocarbon feed is separated into a lighter fraction and a heavier fraction. The lighter fraction is reformed in the presence of a non-acidic catalyst. The heavier fraction is reformed in the presence of an acidic catalyst. The reformate from the non-acidic catalyst is introduced into an extraction where an aromatic extract stream and a non-aromatic raffinate stream are recovered. The raffinate stream can be recycled to the feed. The aromatic extract stream contains 30% benzene, 18% toluene, and 51.8% $C_8$ aromatics.

Solvent extraction is well known as a means of removing aromatics from a reformate stream.

U.S. Pat. No. 2,956,005 discloses solvent extraction of a light fraction of a reformate. That light fraction may have an end point in the range of 220° to 300° F., or it can be a $C_{6+}$, $C_7$, or $C_{7+}$ fraction. The resulting raffinate is recycled to the reforming zone. The reforming catalyst used is a non-zeolitic catalyst.

U. S. Pat. No. 3,121,676 discloses solvent extraction of a $C_{7-}$ fraction of a reformate. A debenzenizer is used after solvent extraction to remove toluene from the final product. The reforming catalyst used is a non-zeolitic catalyst.

U.S. Pat. No. 3,280,022 also discloses solvent extraction of a $C_{7-}$ fraction of a reformate. A debenzenizer is used after solvent extraction to remove toluene from the final product. The reforming catalyst used is a non-zeolitic catalyst.

U.S. Pat. No. 4,358,364 discloses solvent extraction of a light fraction of a reformate. That light fraction is a benzene-rich fraction. The heavier fraction is a toluene-xylene-rich fraction. The reforming catalyst used is a non-zeolitic catalyst.

U.S. Pat. No. 4,648,961 discloses reforming a hydrocarbon feed with a non-acidic zeolitic catalyst, separating an aromatics product from a gaseous stream, separating by solvent extraction normal paraffins and a substantial portion of the single branched isoparaffins from the aromatics, and recycling the normal and single branched isoparaffins to the reforming vessel.

Extractive distillation in general is well known in the art. For example, U.S. Pat. No. 3,434,936 to Luther et al discloses the separation of a mixture of hydrocarbons to aromatic and non-aromatic components by extractive distillation using N-substituted morpholines. U.S. Pat. No. 3,795,588 to Preusser et al discloses a process for separating and recovering diolefins from $C_4$–$C_5$ hydrocarbon mixtures containing paraffins, monoolefins, and diolefins by using an extractive distillation technique.

SUMMARY OF THE INVENTION

The present invention provides a reforming process for producing a high-purity benzene using a non-acidic zeolitic catalyst. The high-purity benzene is extracted from a light fraction of reformate that has less than 500 ppm by weight toluene.

A hydrocarbon feed is reformed in a reformer under reforming conditions in the presence of a catalyst to produce a reformate. That reformate is separated into a light fraction and a heavy fraction. It is important that the light fraction has less than 500 ppm by weight toluene. An extraction unit is used to separate the light fraction into an aromatic extract stream and a non-aromatic raffinate stream.

Preferably, the feed to the reformer contains less than 5 lv % $C_{7+}$ hydrocarbons, more preferably, less than 3 lv %. Preferably, the feed contains less than 1 lv % $C_{8+}$ hydrocarbons, more preferably, less than 0.01 lv %. In one embodiment, a hydrocarbon feed is separated into a light hydrocarbon feed fraction and a heavy hydrocarbon feed fraction, and the light hydrocarbon feed fraction is fed to the reformer.

The catalyst is a non-acidic catalyst comprising a non-acidic zeolite support and at least one Group VIII metal. Preferably, the Group VIII metal is platinum. Preferably, the zeolite is either zeolite L, zeolite X, or zeolite Y. More preferably, the zeolite is zeolite L.

As stated above, it is important that the light fraction of the reformate has less than 500 ppm by weight toluene. Preferably, it contains less than 100 ppm by weight toluene. More preferably, it has less than 50 ppm by weight toluene. Still more preferably, it has less than 25 ppm by weight toluene. In one embodiment, $C_{4-}$ hydrocarbons are removed from the reformate so that the reformate contains less than 0.01 lv % $C_{4-}$ hydrocarbons.

Preferably, the extraction unit is an extractive distillation unit that uses a N-formylmorpholine solvent, and the non-aromatic raffinate stream is recycled to the hydrocarbon feed. Preferably, the final product (the aromatic extract stream) contains at least 99.9 lv % benzene. More preferably, it contains at least 99.95 lv % benzene.

In one embodiment, a 99.95+ lv % benzene is produced by first separating a hydrocarbon feed into a light hydrocarbon fraction, a middle hydrocarbon feed fraction, and a heavy hydrocarbon feed fraction. That middle hydrocarbon feed fraction contains less than 3 lv % $C_{5-}$ hydrocarbons, less than 3 lv % $C_{7+}$ hydrocarbons, and less than 0.01 lv % $C_{8+}$ hydrocarbons. That middle hydrocarbon feed fraction is reformed under reforming conditions in the presence of a non-acidic platinum-zeolite L catalyst to produce a first reformate that is separated into three fractions. The middle first reformate fraction contains less than 0.01 lv % $C_{4-}$ hydrocarbons and less than 25 ppm by weight toluene. The heavy hydrocarbon feed fraction is reformed under reforming conditions in the presence of an acidic catalyst to produce a second reformate that is separated into three fractions. The middle second reformate fraction contains less than 2 lv % $C_{5-}$ hydrocarbons and less than 25 ppm by weight toluene. Both the middle first reformate fraction and the middle second reformate fraction are introduced into an extractive distillation unit that uses a N-formylmorpholine solvent, and an aromatic extract stream (at least 99.95% benzene) and a non-aromatic raffinate stream are removed from the extraction unit. The non-aromatic raffinate stream is recycled to the hydrocarbon feed.

Among other factors, the present invention is based on our discovery that a substantially pure benzene product can be obtained efficiently and effectively by separating a light fraction containing benzene and less than 500 ppm toluene from a product stream obtained from a non-acidic reformer, and then subjecting the light fraction to extraction. The extraction technique employed is most preferably an extractive distillation. Product streams which contain 99.95% lv benzene are readily obtained using the process of the present invention.

BRIEF DESCRIPTION OF THE DRAWING

In order to assist the understanding of this invention, reference will now be made to the appended drawing. The drawing is exemplary only, and should not be construed as limiting the invention.

The FIGURE of the Drawing shows a flow diagram of one embodiment of the present invention.

DETAILED DESCRIPTION OF THE INVENTION

In its broadest aspect, the present invention involves a process for producing a high-purity benzene by solvent extraction of the light fraction of a reformate. That light fraction has less than 500 ppm by weight toluene.

Reformer Feed

A hydrocarbon feed is reformed under reforming conditions in the presence of a catalyst to produce a reformate. The hydrocarbon feed preferably comprises nonaromatic hydrocarbons containing at least six carbon atoms. Preferably, the feedstock is substantially free of sulfur, nitrogen, metals and other known poisons for reforming catalysts.

Preferably, the feed to the reformer contains less than 1 lv % $C_{8+}$ hydrocarbons and less than 5 lv % $C_{7+}$ hydrocarbons. More preferably, the feed contains less than 0.01 lv % $C_{8+}$ hydrocarbons and less than 3 lv % $C_{7+}$ hydrocarbons. Such low levels of $C_{8+}$ and $C_{7+}$ hydrocarbons are needed to maximize the yield of high value benzene and minimize the production of lower value heavier aromatics. This feed can be achieved by separating a hydrocarbon feedstock into a light hydrocarbon feed fraction and a heavy hydrocarbon feed fraction, and using the light fraction.

In another embodiment, the hydrocarbon feed is separated into a light hydrocarbon fraction, a middle hydrocarbon feed fraction, and a heavy hydrocarbon feed fraction. The middle hydrocarbon feed fraction has less than 5 lv % $C_{5-}$ hydrocarbons and less than 5 lv % $C_{7+}$ hydrocarbons. Both the middle hydrocarbon feed fraction and the heavy hydrocarbon feed fraction can be reformed.

Reforming Catalysts

The hydrocarbons can be contacted with one or more catalyst in a single reactor, with two or more catalysts in a series of reactors, or with two catalysts in parallel reactors. At least one of the catalysts should be a non-acidic catalyst. The non-acidic catalyst can be used in combination with an acidic catalyst.

Non-acidic Catalysts

At least one of the catalysts must be a non-acidic catalyst having a non-acidic zeolite support charged with one or more dehydrogenating constituents. Among the zeolites useful in the practice of the present invention are type L zeolite, zeolite X, and zeolite Y. These zeolites have apparent pore sizes on the order of 7 to 9 Angstroms.

Zeolite L is a synthetic crystalline zeolitic molecular sieve which may be written as:

$$(0.9\text{–}1.3)M_{2/n}O:Al_2O3(5.2\text{–}6.9)SiO_2:yH_2O$$

wherein M designates a cation, n represents the valence of M, and y may be any value from 0 to about 9. Zeolite L, its X-ray diffraction pattern, its properties, and method for its preparation are described in detail in U.S. Pat. No. 3,216,789. U.S. Pat. No. 3,216,789 is hereby incorporated by reference to show the preferred zeolite of the present invention. The real formula may vary without changing the crystalline structure; for example, the mole ratio of silicon to aluminum (Si/Al) may vary from 1.0 to 3.5.

Zeolite X is a synthetic crystalline zeolitic molecular sieve which may be represented by the formula:

$$(0.7\text{–}1.1)M_{2/n}O:Al_2O_3:(2.0\text{–}3.0)SiO_2:yH_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244. U.S. Pat. No. 2,882,244 is hereby incorporated by reference to show a zeolite useful in the present invention.

Zeolite Y is a synthetic crystalline zeolitic molecular sieve which may be written as:

$$(0.7\text{–}1.1)Na_2O:Al_2O_3:xSiO_2:yH_2O$$

wherein x is a value greater than 3 up to about 6 and y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130,007 is hereby incorporated by reference to show a zeolite useful in the present invention.

The preferred dehydrocyclization catalyst is a type L zeolite charged with one or more dehydrogenating constituents.

The zeolitic catalysts according to the invention are charged with one or more Group VIII metals, e.g., nickel, ruthenium, rhodium, palladium, iridium or platinum.

The preferred Group VIII metals are iridium and particularly platinum, which are more selective with regard to dehydrocyclization and are also more stable under the dehydrocyclization reaction conditions than other Group VIII metals.

The preferred percentage of platinum in the dehydrocyclization catalyst is between 0.1% and 5%, the lower limit corresponding to minimum catalyst activity and the upper limit to maximum activity. This allows for the high price of platinum, which does not justify using a higher quantity of the metal since the result is only a slight improvement in catalyst activity.

Group VIII metals are introduced into the large-pore zeolite by synthesis, impregnation or exchange in an aqueous solution of appropriate salt. When it is desired to introduce two Group VIII metals into the zeolite, the operation may be carried out simultaneously or sequentially.

By way of example, platinum can be introduced by impregnating the zeolite with an aqueous solution of tetrammineplatinum (II) nitrate, tetrammineplatinum (II) hydroxide, dinitrodiamino-platinum or tetrammineplatinum (II) chloride. In an ion exchange process, platinum can be introduced by using cationic platinum complexes such as tetrammineplatinum (II) nitrate.

An inorganic oxide may be used as a carrier to bind the large-pore zeolite containing the Group VIII metal. The carrier can be a natural or a synthetically produced inorganic oxide or combination of inorganic oxides. Typical inorganic oxide supports which can be used include clays, alumina, and silica, in which acidic sites are preferably exchanged by cations which do not impart strong acidity.

The non-acidic catalyst can be employed in any of the conventional types of equipment known to the art. It may be employed in the form of pills, pellets, granules, broken fragments, or various special shapes, disposed as a fixed bed within a reaction zone, and the charging stock may be passed therethrough in the liquid, vapor, or mixed phase, and in either upward or downward flow. Alternatively, it may be prepared in a suitable form for use in moving beds, or in fluidized-solid processes, in which the charging stock is passed upward through a turbulent bed of finely divided catalyst.

Acidic Catalysts

An acidic catalyst can be used in conjunction with the non-acidic catalyst. The acidic catalyst can comprise a metallic oxide support having disposed therein a Group VIII metal. Suitable metallic oxide supports include alumina and silica. Preferably, the acidic catalyst comprises a metallic oxide support having disposed therein in intimate admixture a Group VIII metal (preferably platinum) and a Group VIII metal promoter, such as rhenium, tin, germanium, cobalt, nickel, iridium, rhodium, ruthenium and combinations thereof. More preferably, the acidic catalyst comprises an alumina support, platinum, and rhenium.

Reforming Conditions

The reforming is carried out in the presence of hydrogen at a pressure adjusted to favor the dehydrocyclization reaction thermodynamically and to limit undesirable hydrocracking reactions. The pressures used preferably vary from 1 atmosphere to 500 psig, more preferably from 50 to 300 psig, the molar ratio of hydrogen to hydrocarbons preferably being from 1:1 to 10:1, more preferably from 2:1 to 6:1.

In the temperature range of from 400° C. to 600° C., the dehydrocyclization reaction occurs with acceptable speed and selectivity. If the operating temperature of is below 400° C., the reaction speed is insufficient and consequently the yield is too low for industrial purposes. When the operating temperature of dehydrocyclization is above 600° C., interfering secondary reactions such as hydrocracking and coking occur, and substantially reduce the yield. It is not advisable, therefore, to exceed the temperature of 600° C. The preferred temperature range (430° C. to 550° C.) of dehydrocyclization is that in which the process is optimum with regard to activity, selectivity and the stability of the catalyst.

The liquid hourly space velocity of the hydrocarbons in the dehydrocyclization reaction is preferably between 0.3 and 5.

Separation Step

The reformate is separated into a light fraction and a heavy fraction. It is essential that the light fraction has less than 500 ppm by weight toluene. Preferably, the light fraction contains less than 100 ppm by weight toluene. More preferably, the light fraction contains less than 50 ppm by weight toluene. Still more preferably, the light fraction contains less than 25 ppm by weight toluene. The reason for this is that any toluene in the light fraction will remain with the final benzene product after the extraction step, thus lowering its purity and value.

Preferably, $C_{4-}$ hydrocarbons are removed from the reformate to produce $C_{5+}$ hydrocarbon rich reformate that contains less than 0.01 lv % $C_{4-}$ hydrocarbons. The reason for this is to keep vapor pressure of the extraction unit feed to a minimum. This allows the extraction unit to run at a lower pressure, thus improving benzene recovery and saving capital and energy costs.

Extraction Step

The light fraction is introduced into an extraction unit. There, an aromatic extract stream and a non-aromatic raffinate stream are separated and removed from the extraction unit. Preferably, the aromatic extract stream contains at least 99.9 lv % benzene. More preferably, it contains at least 99.95 lv % benzene.

The separation of aromatics using extraction is well known in the art. Generally, the extraction is either a liquid/liquid extraction (for example, using sulfolane as the solvent) or an extractive distillation. Extractive distillation is preferred, since the concentration of aromatics in the feed to the extraction unit is high and benzene is the desired product.

Extractive distillation technology is available commercially. For example, such a process includes preparing high purity benzene from pyrolysis gasoline using N-methyl pyrrolidone as the solvent. Whole pyrolysis gasoline is fractionated prior to treatment and the resulting benzene concentrate is usually hydrotreated. Another process involves extractive distillation with N-substituted morpholines as the extractive distillation solvent. Vendors for such technology, include, for example, Krupp Koppers GmbH.

Preferably, the extraction unit comprises an extractive distillation unit using a N-formylmorpholine solvent. Such a unit would consist of an extractive distillation column and a stripper column. The extractive distillation column contacts the light fraction with the N-formylmorpholine solvent, thus suppressing the boiling point of the aromatics and allowing the non-aromatics to be taken overhead. The stripper column separates the remaining aromatics from the N-formylmorpholine solvent using simple distillation.

The non-aromatic raffinate recovered from the extraction process may be recycled and added to the $C_6$ fraction feed or other places prior to the reformers for catalytic dehydrocyclization which increases the benzene yield of the process.

In one embodiment, the hydrocarbon feed is separated into a light fraction and a heavy fraction. The light fraction is reformed to produce a reformate under reforming conditions in the presence of a non-acidic catalyst having at least one Group VIII metal and a non-acidic zeolite support. The $C_{4-}$ hydrocarbons are removed from the reformate to produce a $C_{5+}$ hydrocarbon rich reformate that contains less than 0.01 lv % $C_{4-}$ hydrocarbons. The $C_{5+}$ hydrocarbon rich reformate is separated into a light reformate fraction and a heavy reformate fraction. The light reformate fraction has less than 500 ppm by weight toluene. This light reformate fraction is introduced into an extraction unit, and an aromatic extract stream and a non-aromatic raffinate stream are removed from the extraction unit. Preferably, the light reformate is introduced directly into the extraction unit, as in a preferred embodiment pretreatments such as clay treating, carbon treating, or hydrotreating, are not necessary to produce a benzene product of high purity.

In another embodiment, the hydrocarbon feed is separated into a light, middle, and heavy fraction. The middle fraction contains less than 5 lv % $C_{5-}$ hydrocarbons and less than 5 lv % $C_{7+}$ hydrocarbons. This middle fraction is reformed to produce a reformate under reforming conditions in the presence of a non-acidic catalyst having at least one Group VIII metal and a non-acidic zeolite support. The $C_{4-}$ hydrocarbons are removed from the reformate to produce $C_{5+}$ hydrocarbon rich reformate that contains less than 0.01 lv % $C_{4-}$ hydrocarbons, and the $C_{5+}$ hydrocarbon rich reformate is separated into a light reformate fraction (with less than 500 ppm by weight toluene) and a heavy reformate fraction. That light reformate fraction is introduced into an extraction unit, and an aromatic extract stream and a non-aromatic raffinate stream are separated and removed from the extraction unit. The extract stream contains at least 99.9 lv % benzene.

In still another embodiment, the hydrocarbon feed is separated into a light, middle, and heavy fraction. The middle hydrocarbon feed fraction contains less than 5 lv % $C_{5-}$ hydrocarbons, less than 5 lv % $C_{7+}$ hydrocarbons, and less than 0.01 lv % $C_{8+}$ hydrocarbons. This middle fraction is reformed to produce a first reformate under reforming conditions in the presence of a non-acidic catalyst that has at least one Group VIII metal and a non-acidic zeolite support. The heavy fraction is reformed under reforming conditions in the presence of an acidic catalyst to produce a second reformate. Both reformates are separated into a light, middle, and heavy reformate fraction. Both middle reformate fractions contain less than 0.01 lv % $C_{4-}$ hydrocarbons and less than 50 ppm by weight toluene. Both middle reformate fractions are introduced into an extraction unit, an aromatic extract stream and a non-aromatic raffinate stream are separated and removed from the extraction unit. The aromatic extract stream contains at least 99.95 lv % benzene. The non-aromatic raffinate stream is recycled to the hydrocarbon feed.

In a more specific embodiment, a hydrocarbon feed is reformed to produce a stream that contains at least 99.95 lv % benzene. First, the hydrocarbon feed is separated into a light, middle, and heavy fraction. The middle hydrocarbon feed fraction contains less than 5 lv % $C_{5-}$ hydrocarbons, less than 3 lv % $C_{7+}$ hydrocarbons, and less than 0.01 lv % $C_{8+}$ hydrocarbons. This middle fraction is reformed to produce a first reformate under reforming conditions in the presence of a non-acidic catalyst having platinum and a non-acidic zeolite L support. The heavy fraction is reformed under reforming conditions in the presence of an acidic catalyst to produce a second reformate. Both reformates are separated into a light, middle, and heavy reformate fraction. Both middle reformate fractions contains less than 0.01 lv % $C_{4-}$ hydrocarbons and less than 25 ppm by weight toluene. Both middle reformate fractions are introduced into an extractive distillation unit that uses a N-formylmorpholine solvent. An aromatic extract stream and a non-aromatic raffinate stream are separated and removed from the extraction unit. The aromatic extract stream contains at least 99.95 lv % benzene. The non-aromatic raffinate stream is recycled to the hydrocarbon feed.

EXAMPLES

The invention will be further illustrated by following examples which set forth particularly advantageous method embodiments. While the Examples are provided to illustrate the present invention, they are not intended to limit it.

Referring to FIG. 1, in one embodiment, a crude unit light straight run 1 is fed to a depentanizer 20 to produce a $C_{5-}$ fraction stream 3 and a $C_{6+}$ stream. The $C_{6+}$ stream is fed to dehexanizer 25 to produce a $C_6$ feed fraction 5 and a $C_{7+}$ feed fraction 4. The $C_6$ feed fraction 5 contains less than 3 lv % $C_{5-}$ hydrocarbons, less than 3 lv % $C_{7+}$ hydrocarbons, and less than 0.01 lv % $C_{8+}$ hydrocarbons.

The $C_6$ feed fraction 5 is reformed in non-acidic reformer 30 to produce a first reformate under reforming conditions in the presence of a non-acidic catalyst that comprises platinum and a non-acidic zeolite L support. The first reformate is passed into a flash drum 35 to remove light gases, which can be recycled to the non-acidic reformer 30 or sent to net gas.

The first reformate and a side stream of other low boiling aromatics are sent to stabilizer 40 and benzene/toluene separator 45, which, in combination, separate the first reformate into a $C_{4-}$ fraction, a middle fraction 8, and a heavy fraction 7. The middle fraction 8 contains less than 0.01 lv % $C_{4-}$ hydrocarbons and less than 500 ppm by weight toluene, and most preferably less than 25 ppm by weight toluene.

The middle reformate fraction 8 is sent to an extractive distillation unit 50 that uses a N-formylmorpholine solvent. An aromatic extract stream 13 and a non-aromatic raffinate stream 2 are separated and removed from the extraction unit 50. The aromatic extract stream 13 contains at least 99.95 lv % benzene. The non-aromatic raffinate stream 2, which contains primarily unconverted $C_6$, is recycled to the hydrocarbon feed.

A sample material balance for such a system is given below, with all compositions in lv %:

| Stream | $C_{5-}$ | $C_6$ | Benzene | Toluene | $C_7$ | $C_{8+}$ |
|---|---|---|---|---|---|---|
| 1 | 18.36 | 30.75 | 0.86 | 2.30 | 31.28 | 16.45 |
| 3 | 86.75 | 12.84 | 0.33 | 0.00 | 0.07 | 0.00 |
| 5 | 2.39 | 93.62 | 2.01 | 0.00 | 1.97 | 0.00 |
| 6 | 15.98 | 5.37 | 41.57 | 28.34 | 1.69 | 7.04 |
| 7 | 0.00 | 0.00 | 1.23 | 71.58 | 0.01 | 27.18 |
| 8 | 2.72 | 19.91 | 77.07 | 0.00 | 0.28 | 0.02 |
| 13 | 0.00 | 0.00 | 100.00 | 0.00 | 0.00 | 0.00 |

In another embodiment, the $C_{7+}$ feed fraction obtained from the dehexanizer 25 and a side stream of other reformer feeds can be reformed in an acidic reformer under reforming conditions in the presence of an acidic catalyst to produce a second reformate. This second reformate can then be sent to a dehexanizer and a depentanizer, which in combination can separate the second reformate into a $C_{5-}$ fraction, a middle fraction, and a $C_{7+}$ fraction. The middle fraction will generally contain less than 0.01 lv % $C_{4-}$ hydrocarbons and less than 25 ppm by weight toluene. If desired, this middle fraction can be sent to the extraction distillation unit 50.

While the present invention has been described with reference to specific embodiments, this application is intended to cover those various changes and substitutions that may be made by those skilled in the art without departing from the spirit and scope of the appended claims.

What is claimed is:

1. A process for producing a stream that contains aromatics comprising:

(a) reforming a hydrocarbon feed under reforming conditions in the presence of a non-acidic catalyst to produce a reformate, wherein the non-acidic catalyst comprises at least one Group VIII metal and a non-acidic zeolite support;

(b) separating the reformate into a light fraction and a heavy fraction, wherein the light fraction has less than 500 ppm by weight toluene;

(c) introducing the light fraction into an extraction unit; and (d) separating and removing an aromatic extract stream and a non-aromatic raffinate stream from the extraction unit.

2. A process according to claim 1 wherein the hydrocarbon feed contains less than 5 lv % $C_{7+}$ hydrocarbons.

3. A process according to claim 2 wherein the hydrocarbon feed contains less than 3 lv % $C_{7+}$ hydrocarbons.

4. A process according to claim 2 wherein the hydrocarbon feed contains less than 1 lv % $C_{8+}$ hydrocarbons.

5. A process according to claim 4 wherein the hydrocarbon feed contains less than 0.01 lv % $C_{8+}$ hydrocarbons.

6. A process according to claim 1 wherein the catalyst comprises platinum.

7. A process according to claim 1 wherein the zeolite is selected from the group consisting of zeolite L, zeolite X, and zeolite Y.

8. A process according to claim 7 wherein the zeolite is zeolite L.

9. A process according to claim 1 wherein the light fraction contains less than 100 ppm by weight toluene.

10. A process according to claim 9 wherein the light fraction contains less than 50 ppm by weight toluene.

11. A process according to claim 10 wherein the light fraction contains less than 25 ppm by weight toluene.

12. A process according to claim 1 wherein the aromatic extract stream contains at least 99.9 lv % benzene.

13. A process according to claim 12 wherein the aromatic extract stream contains at least 99.95 lv % benzene.

14. A process according to claim 1 wherein the extraction unit comprises an extractive distillation unit.

15. A process according to claim 14 wherein the extractive distillation unit uses a N-formylmorpholine solvent.

16. A process according to claim 1 further comprising the step of recycling the non-aromatic raffinate stream to the hydrocarbon feed.

17. A process for producing a stream that contains aromatics comprising:

(a) separating a hydrocarbon feed into a light hydrocarbon feed fraction and a heavy hydrocarbon feed fraction;

(b) reforming the light hydrocarbon feed fraction under reforming conditions in the presence of a non-acidic catalyst to produce a reformate, wherein the non-acidic catalyst comprises at least one Group VIII metal and a non-acidic zeolite support;

(c) removing $C_{4-}$ hydrocarbons from the reformate to produce $C_{5+}$ hydrocarbon rich reformate that contains less than 0.01 lv % $C_{4-}$ hydrocarbons;

(d) separating the $C_{5+}$ hydrocarbon rich reformate into a light reformate fraction and a heavy reformate fraction, wherein the light reformate fraction has less than 500 ppm by weight toluene;

(e) introducing the light reformate fraction into an extraction unit; and (f) separating and removing an aromatic extract stream and a non-aromatic raffinate stream from the extraction unit.

18. A process according to claim 17 wherein the light hydrocarbon feed fraction contains less than 4 lv % $C_{7+}$ hydrocarbons.

19. A process according to claim 18 wherein the light hydrocarbon feed fraction contains less than 3 lv % $C_{7+}$ hydrocarbons.

20. A process according to claim 18 wherein the light hydrocarbon feed fraction contains less than 1 lv % $C_{8+}$ hydrocarbons.

21. A process according to claim 20 wherein the light hydrocarbon feed fraction contains less than 0.01 lv % $C_{8+}$ hydrocarbons.

22. A process according to claim 17 wherein the catalyst comprises platinum.

23. A process according to claim 17 wherein the zeolite is selected from the group consisting of zeolite L, zeolite X, and zeolite Y.

24. A process according to claim 23 wherein the zeolite is zeolite L.

25. A process according to claim 17 wherein the light reformate fraction contains less than 100 ppm by weight toluene.

26. A process according to claim 25 wherein the light reformate fraction contains less than 50 ppm by weight toluene.

27. A process according to claim 26 wherein the light reformate fraction contains less than 25 ppm by weight toluene.

28. A process according to claim 17 wherein the aromatic extract stream contains at least 99.9 lv % benzene.

29. A process according to claim 28 wherein the aromatic extract stream contains at least 99.95 lv % benzene.

30. A process according to claim 17 wherein the extraction unit comprises an extractive distillation unit.

31. A process according to claim 30 wherein the extractive distillation unit uses a N-formylmorpholine solvent.

32. A process according to claim 17 further comprising the step of recycling the non-aromatic raffinate stream to the hydrocarbon feed.

33. A process for producing a stream that contains at least 99.9 lv % benzene, said process comprising:

(a) separating the hydrocarbon feed into a light fraction, a middle hydrocarbon feed fraction, and a heavy hydrocarbon feed fraction, wherein the middle hydrocarbon feed fraction contains less than 5 lv % $C_{5-}$ hydrocarbons and less than 5 lv % $C_{7+}$ hydrocarbons;

(b) reforming the middle hydrocarbon feed fraction under reforming conditions in the presence of a non-acidic catalyst to produce a reformate, wherein the non-acidic catalyst comprises at least one Group VIII metal and a non-acidic zeolite support;

(c) removing $C_{4-}$ hydrocarbons from the reformate to produce $C_{5+}$ hydrocarbon rich reformate that contains less than 0.01 lv % $C_{4-}$ hydrocarbons;

(d) separating the $C_{8+}$ hydrocarbon rich reformate into a light reformate fraction and a heavy reformate fraction, wherein the light reformate fraction has less than 500 ppm by weight toluene;

(e) introducing the light reformate fraction into an extraction unit; and (f) separating and removing an aromatic extract stream and a non-aromatic raffinate stream from the extraction unit, wherein the aromatic extract stream contains at least 99.9 lv % benzene.

34. A process according to claim 33 wherein the middle hydrocarbon feed fraction contains less than 3 lv % $C_{7+}$ hydrocarbons.

35. A process according to claim 33 wherein the middle hydrocarbon feed fraction contains less than 1 lv % $C_{8+}$ hydrocarbons.

36. A process according to claim 35 wherein the middle hydrocarbon feed fraction contains less than 0.01 lv % $C_{8+}$ hydrocarbons.

37. A process according to claim 33 wherein the non-acidic catalyst comprises platinum and a non-acidic zeolite L support.

38. A process according to claim 33 wherein the light reformate fraction contains less than 100 ppm by weight toluene.

39. A process according to claim 38 wherein the light reformate fraction contains less than 50 ppm by weight toluene.

40. A process according to claim 39 wherein the light reformate fraction contains less than 25 ppm by weight toluene.

41. A process according to claim 33 wherein the aromatic extract stream contains at least 99.95 lv % benzene.

42. A process according to claim 33 wherein the extraction unit comprises an extractive distillation unit.

43. A process according to claim 42 wherein the extractive distillation unit uses a N-formylmorpholine solvent.

44. A process according to claim 33 further comprising the step of recycling the non-aromatic raffinate stream to the hydrocarbon feed.

45. A process for producing a stream that contains at least 99.9 lv % benzene, said process comprising:

(a) separating a hydrocarbon feed into a light fraction, a middle hydrocarbon feed fraction, and a heavy hydrocarbon feed fraction, wherein the middle hydrocarbon feed fraction contains:
(1) less than 5 lv % $C_{5-}$ hydrocarbons,
(2) less than 5 lv % $C_{7+}$ hydrocarbons, and
(3) less than 1 lv % $C_{8+}$ hydrocarbons;

(b) reforming the middle hydrocarbon feed fraction under reforming conditions in the presence of a non-acidic catalyst to produce a first reformate, wherein the non-acidic catalyst comprises platinum and a non-acidic zeolite L support;

(c) separating the first reformate into a light first reformate fraction, a middle first reformate fraction, and a heavy first reformate fraction, wherein the middle first reformate fraction contains:
(1) less than 0.01 lv % $C_{4-}$ hydrocarbons and
(2) less than 50 ppm by weight toluene;

(d) reforming the heavy hydrocarbon feed fraction under reforming conditions in the presence of an acidic catalyst to produce a second reformate;

(e) separating the second reformate into a light second reformate fraction, a middle second reformate fraction, and a heavy second reformate fraction, wherein the middle second reformate fraction contains:
(1) less than 2 lv % $C_{5-}$ hydrocarbons and
(2) less than 50 ppm by weight toluene;

(f) introducing the middle first reformate fraction and the middle second reformate fraction into an extraction unit;

(g) separating and removing an aromatic extract stream and a non-aromatic raffinate stream from the extraction unit, wherein the aromatic extract stream contains at least 99.9 lv % benzene; and (h) recycling the non-aromatic raffinate stream to the hydrocarbon feed.

46. A process according to claim 45 wherein the middle hydrocarbon feed fraction contains less than 3 lv % $C_{7+}$ hydrocarbons.

47. A process according to claim 45 wherein the middle hydrocarbon feed fraction contains less than 0.01 lv % $C_{8+}$ hydrocarbons.

48. A process according to claim 45 wherein the middle first reformate fraction contains less than 25 ppm by weight toluene and the middle second reformate fraction contains less than 25 ppm by weight toluene.

49. A process according to claim 45 wherein the aromatic extract stream contains at least 99.95 lv % benzene.

50. A process according to claim 45 wherein the extraction unit comprises an extractive distillation unit.

51. A process according to claim 50 wherein the extractive distillation unit uses a N-formylmorpholine solvent.

52. A process for producing a stream that contains at least 99.95 lv % benzene, said process comprising:

(a) separating a hydrocarbon feed into a light fraction, a middle hydrocarbon feed fraction, and a heavy hydrocarbon feed fraction, wherein the middle hydrocarbon feed fraction contains:
(1) less than 3 lv % $C_{5-}$ hydrocarbons,
(2) less than 3 lv % $C_{7+}$ hydrocarbons, and
(3) less than 0.01 lv % $C_{8+}$ hydrocarbons;

(b) reforming the middle hydrocarbon feed fraction under reforming conditions in the presence of a non-acidic catalyst to produce a first reformate, wherein the non-acidic catalyst comprises platinum and a non-acidic zeolite L support;

(c) separating the first reformate into a light first reformate fraction, a middle first reformate fraction, and a heavy first reformate fraction, wherein the middle first reformate fraction contains:
(1) less than 0.01 lv % $C_{4-}$ hydrocarbons and
(2) less than 25 ppm by weight toluene;

(d) reforming the heavy hydrocarbon feed fraction under reforming conditions in the presence of an acidic catalyst to produce a second reformate;

(e) separating the second reformate into a light second reformate fraction, a middle second reformate fraction, and a heavy second reformate fraction, wherein the middle second reformate fraction contains:
(1) less than 2 lv % $C_{5-}$ hydrocarbons and
(2) less than 25 ppm by weight toluene;

(f) introducing the middle first reformate fraction and the middle second reformate fraction into an extractive distillation unit that uses a N-formylmorpholine solvent;

(g) separating and removing an aromatic extract stream and a non-aromatic raffinate stream from the extraction unit, wherein the aromatic extract stream contains at least 99.95 lv % benzene; and (h) recycling the non-aromatic raffinate stream to the hydrocarbon feed.

* * * * *